US009480616B2

(12) United States Patent
Kreuzer et al.

(10) Patent No.: US 9,480,616 B2
(45) **Date of Patent: *Nov. 1, 2016**

(54) SURGICAL TABLE WITH PIVOTABLE FEMORAL SUPPORT

(71) Applicant: Innovative Orthopedic Technologies, LLC, Houston, TX (US)

(72) Inventors: Stefan Kreuzer, Houston, TX (US); Joseph W. Pieczynski, II, Austin, TX (US); Adam Freedhand, Houston, TX (US)

(73) Assignee: INNOVATIVE ORTHOPEDIC TECHNOLOGIES, LLC, Houston, TX (US)

( * ) Notice: Subject to any disclaimer, the term of this patent is extended or adjusted under 35 U.S.C. 154(b) by 147 days.

This patent is subject to a terminal disclaimer.

(21) Appl. No.: 14/634,254

(22) Filed: Feb. 27, 2015

(65) Prior Publication Data

US 2015/0164728 A1 Jun. 18, 2015

Related U.S. Application Data

(63) Continuation of application No. 14/081,553, filed on Nov. 15, 2013, now Pat. No. 8,997,284.

(60) Provisional application No. 61/726,863, filed on Nov. 15, 2012.

(51) Int. Cl.

| | |
|---|---|
| ***A61G 13/12*** | (2006.01) |
| ***A61G 7/075*** | (2006.01) |
| *A61G 13/00* | (2006.01) |

(52) U.S. Cl.

CPC ..... *A61G 13/1245* (2013.01); *A61G 7/075* (2013.01); *A61G 7/0755* (2013.01); *A61G 13/123* (2013.01); *A61G 13/1295* (2013.01); *A61G 2013/0063* (2013.01); *A61G 2013/0081* (2013.01)

(58) Field of Classification Search

CPC ..... A61G 13/02; A61G 13/08; A61G 13/12; A61G 13/1205; A61G 13/123; A61G 13/1245; A61G 13/126; A61G 13/1285; A61G 13/1295; A61G 7/075; A61G 7/0755; A61G 2013/0081; A61G 2013/0063; A61G 2210/10

See application file for complete search history.

(56) References Cited

U.S. PATENT DOCUMENTS

| | | | | |
|---|---|---|---|---|
| 4,443,005 | A * | 4/1984 | Sugarman | A61G 13/12 378/208 |
| 4,940,218 | A * | 7/1990 | Akcelrod | A61G 13/0036 5/621 |
| 4,989,848 | A | 2/1991 | Monroe | |
| 5,645,079 | A * | 7/1997 | Zahiri | A61F 5/3769 128/882 |
| 6,286,164 | B1 * | 9/2001 | Lamb | A61G 13/0036 128/845 |
| 6,295,671 | B1 | 10/2001 | Reesby et al. | |

(Continued)

OTHER PUBLICATIONS

Office Action dated Aug. 4, 2014; U.S. Appl. No. 14/081,553 (8 p.).

(Continued)

*Primary Examiner* — Robert G Santos
*Assistant Examiner* — David R Hare
(74) *Attorney, Agent, or Firm* — Conley Rose, P.C.

(57) ABSTRACT

A femoral support system includes a plate configured to support the pelvis of a patient on a table. In addition, the system includes a femoral support pivotally coupled to the plate and configured to support the thigh of the patient.

20 Claims, 9 Drawing Sheets

(56) References Cited

U.S. PATENT DOCUMENTS

| | | | | |
|---|---|---|---|---|
| RE41,412 | E | 7/2010 | Van Steenburg | |
| 7,832,401 | B2 * | 11/2010 | Torrie | A61G 13/0036 128/845 |
| 7,947,006 | B2 * | 5/2011 | Torrie | A61G 13/0036 128/845 |
| 8,555,439 | B2 | 10/2013 | Soto et al. | |
| 8,997,284 | B2 * | 4/2015 | Kreuzer | A61G 13/1245 128/845 |
| RE46,032 | E * | 6/2016 | Torrie | A61H 1/0218 |
| 2004/0133979 | A1 * | 7/2004 | Newkirk | A61G 13/0036 5/600 |
| 2007/0161935 | A1 | 7/2007 | Torrie et al. | |
| 2007/0251011 | A1 * | 11/2007 | Matta | A61B 19/0248 5/624 |
| 2010/0263129 | A1 * | 10/2010 | Aboujaoude | A61F 5/3761 5/650 |
| 2011/0023893 | A1 * | 2/2011 | Striggow | A61G 13/12 128/882 |
| 2011/0099720 | A1 * | 5/2011 | Wyslucha | A61G 13/0036 5/658 |
| 2011/0190676 | A1 | 8/2011 | Torrie et al. | |
| 2012/0318278 | A1 | 12/2012 | Aboujaoude et al. | |
| 2013/0191995 | A1 * | 8/2013 | Bellows | A61G 13/0036 5/624 |
| 2014/0215718 | A1 * | 8/2014 | Wootton | A61G 13/0036 5/621 |

OTHER PUBLICATIONS

Response to Office Action Dated Aug. 4, 2014; U.S. Appl. No. 14/081,553; Response dated Nov. 4, 2014 (13 p.).

Notice of Allowance dated Dec. 24, 2014; U.S. Appl. No. 14/081,553 (6 p.).

* cited by examiner

SURGICAL TABLE WITH PIVOTABLE FEMORAL SUPPORT

CROSS-REFERENCE TO RELATED APPLICATIONS

This application is a continuation of U.S. application Ser. No. 14/081,553 filed Nov. 15, 2013, entitled "Surgical Table with Pivotable Femoral Support," which claims the benefit of U.S. Provisional Application Ser. No. 61/726,863 filed on Nov. 15, 2012, entitled "Surgical Table with Pivotable Femoral Support," the disclosure of which is incorporated herein by reference in entirety for all purposes.

STATEMENT REGARDING FEDERALLY SPONSORED RESEARCH OR DEVELOPMENT

Not applicable.

BACKGROUND

The present disclosure relates generally devices and methods for supporting and manipulating a patient's leg during surgery (e.g., hip joint surgery) and for diagnostic analysis of the leg (e.g. x-ray).

During diagnostic evaluation of a patient's leg or surgery on a patient's leg (e.g., hip or knee surgery), certain positions and orientations of the leg and hip joint may be preferred. For example, during one phase of hip surgery, the surgeon may want to place the patient's leg in tension (i.e., traction) at an angle with respect to the spine or the pelvis, whereas in another phase of hip surgery, the surgeon may want to rotate the patient's leg about a certain axis while maintaining traction. Moreover, in some cases, the surgeon may want to maintain traction or a particular rotational orientation of the patient's leg while adjusting the other or adjusting the patient's position on the surgical table.

Most conventional surgical tables designed for use in leg surgeries include a perineal post that is fixed to the table and positioned between the patient's legs against the perineum. The perineal post functions to maintain the patient's position on the surgical table while the patient's leg is pulled inferiorly (i.e., generally away from the patient's torso). This enables the application of inferior traction to the patient's leg by applying tension generally along the length of the leg. However, for some surgeries and diagnostic evaluations, it may be desirable to apply dorsal fraction to the femur to distract the hip joint ventrally. Although conventional surgical tables and associated traction devices enable the application of inferior traction, they provide very limited, if any, ability to controllably apply dorsal or ventral traction to the femur.

BRIEF SUMMARY OF THE DISCLOSURE

These and other needs in the art are addressed in one embodiment by a femoral support system. In an embodiment, the system comprises a plate configured to support the pelvis of a patient on a table. In addition, the system comprises a femoral support pivotably coupled to the plate and configured to support the thigh of the patient.

These and other needs in the art are addressed in another embodiment by a femoral support system. In an embodiment, the system comprises a pelvic support plate configured to be moveably coupled to a table. In addition, the system comprises a perineal post coupled to the support plate. Further, the system comprises a femoral support pivotally coupled to the perineal post with a pivot assembly. The femoral support is configured to pivot relative to the support plate about a first axis and a second axis oriented perpendicular to the first axis. The first axis is horizontal and the second axis lies in a vertical plane.

The present disclosure relates to a system for manipulating and supporting a patient's leg during an operation. The system for manipulating a patient during a medical procedure comprises a plate having a base disposed thereon and a post extending vertically from the base. A femoral support is pivotably coupled to the plate, such that the support may rotate in a vertical plane, parallel to the post. The femoral support configured to support a patient's upper leg and apply fraction during an orthopedic procedure Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
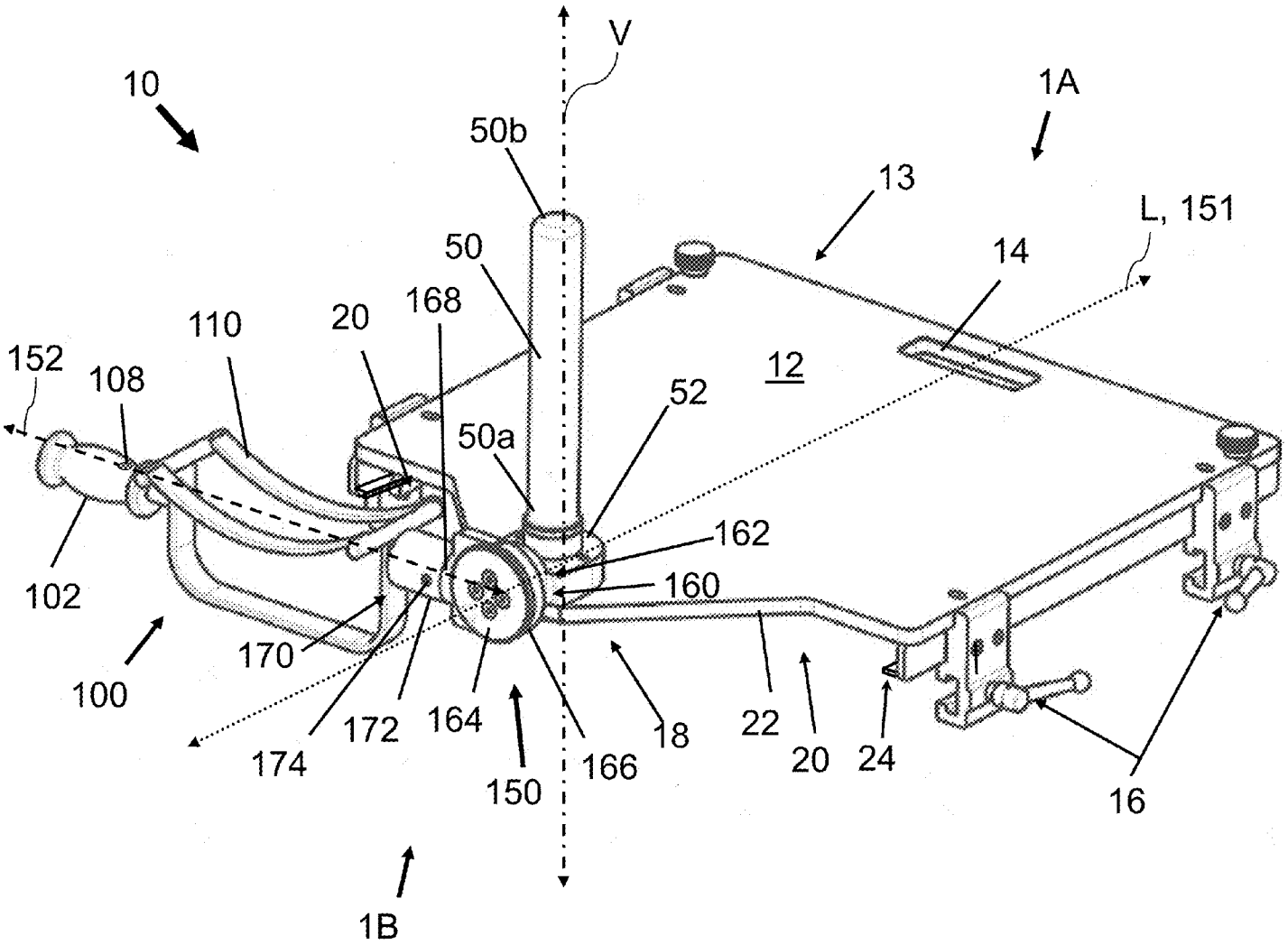
FIG. 1 is a perspective view of an embodiment of an adjustable femoral support system in accordance with the principles described herein.
Figure 2:
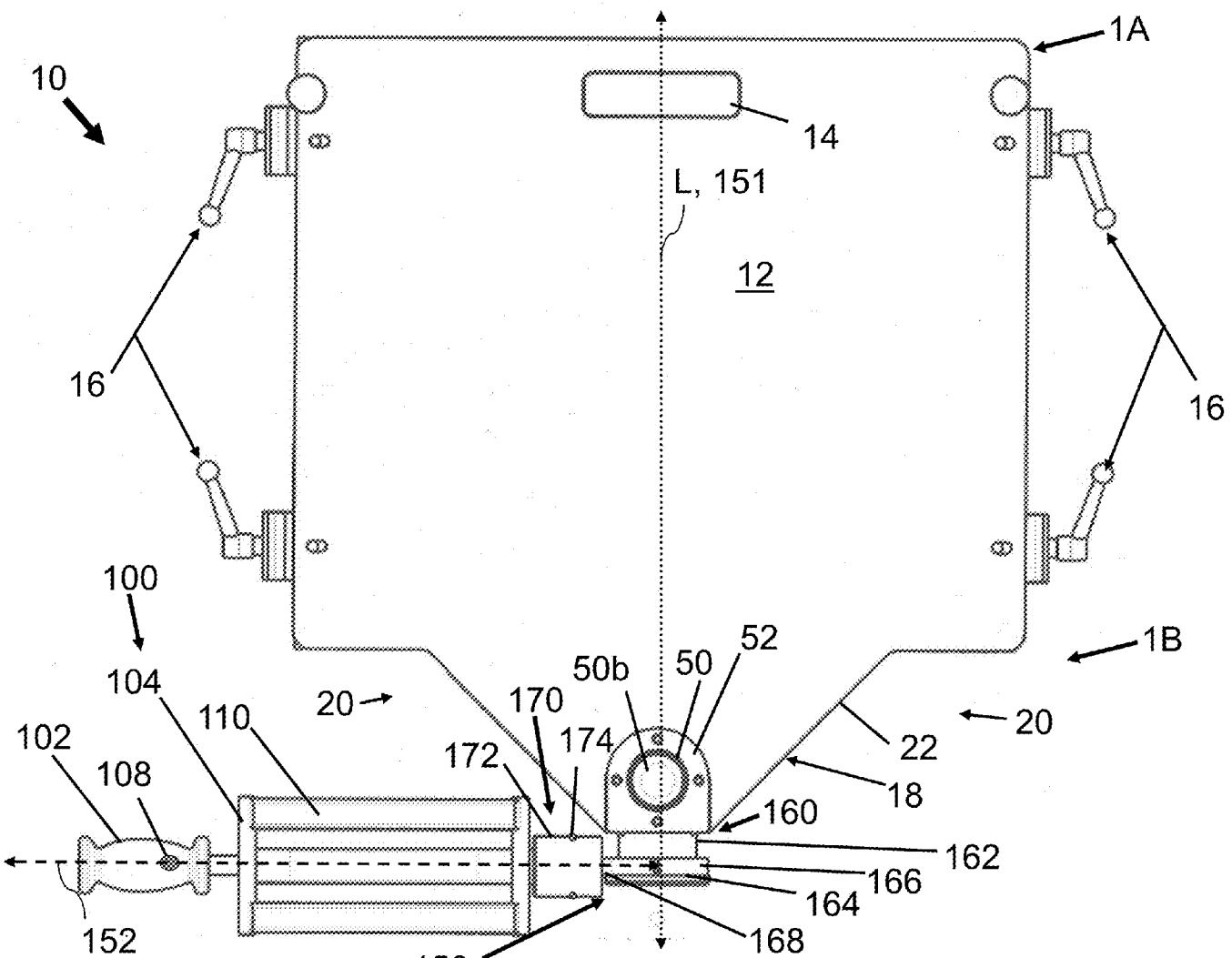
FIG. 2 is a top view of the system of FIG. 1.
Figure 3:
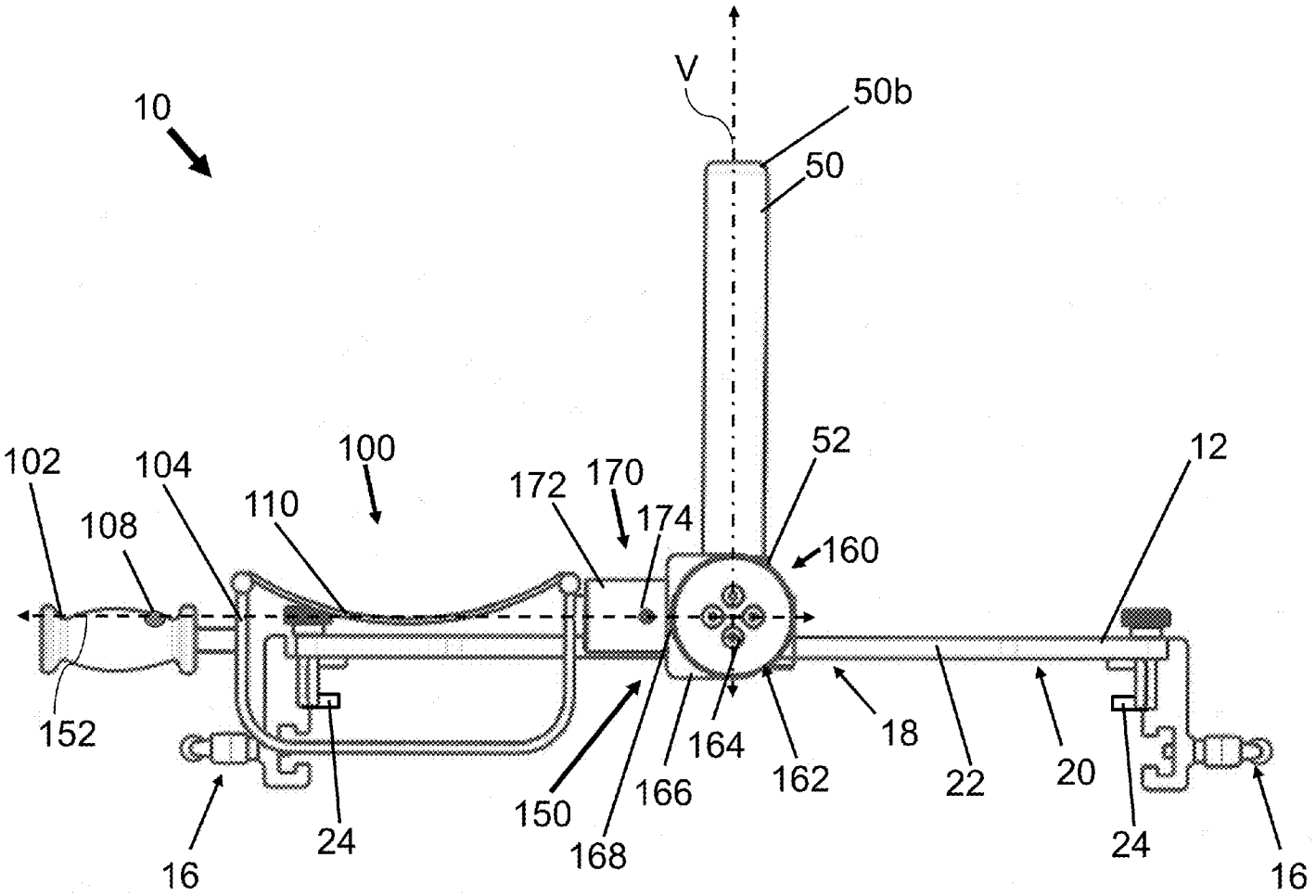
FIG. 3 is a front view of the system of FIG. 1.
Figure 4:
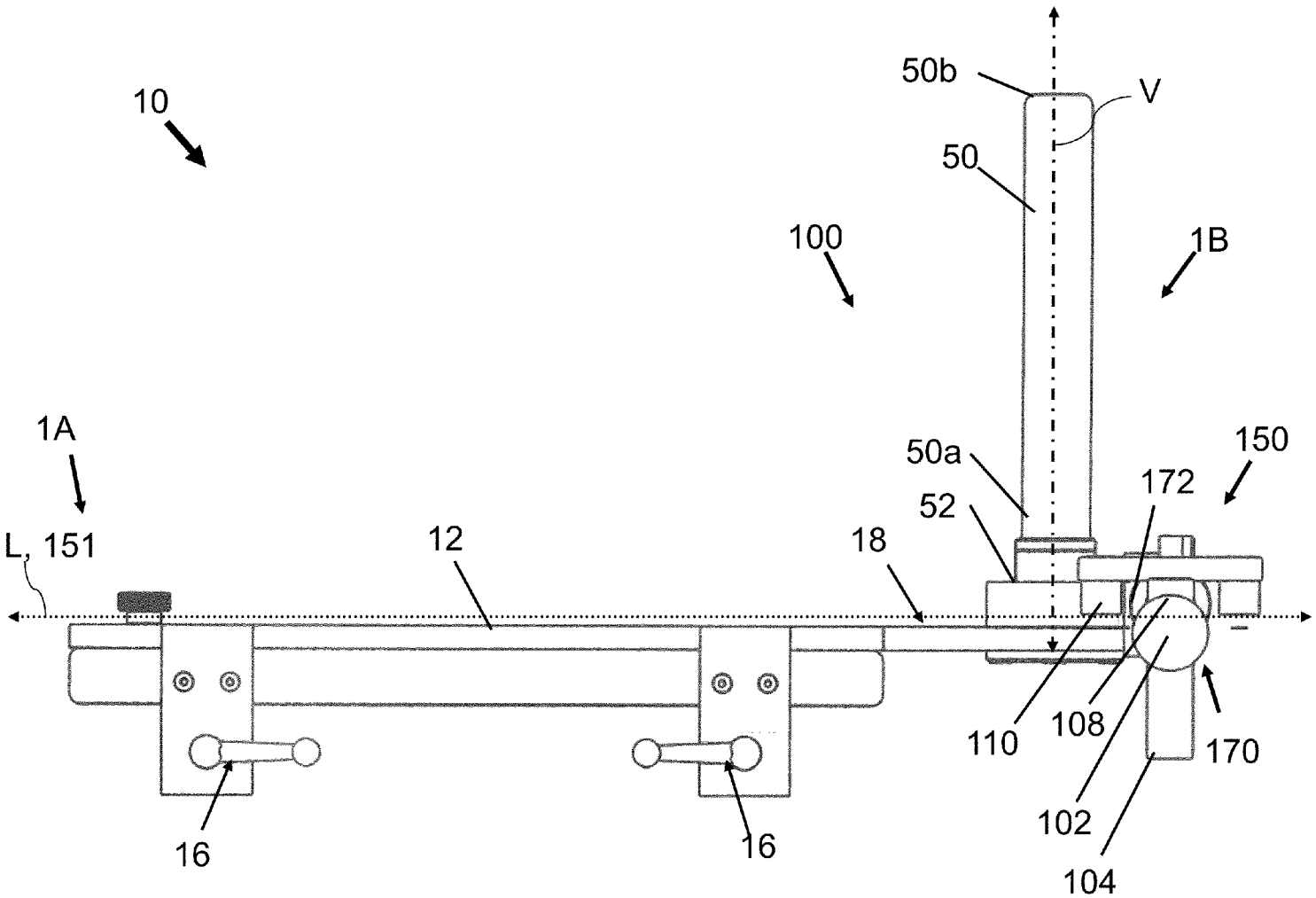
FIG. 4 is a side view of the system of FIG. 1.
Figure 5:
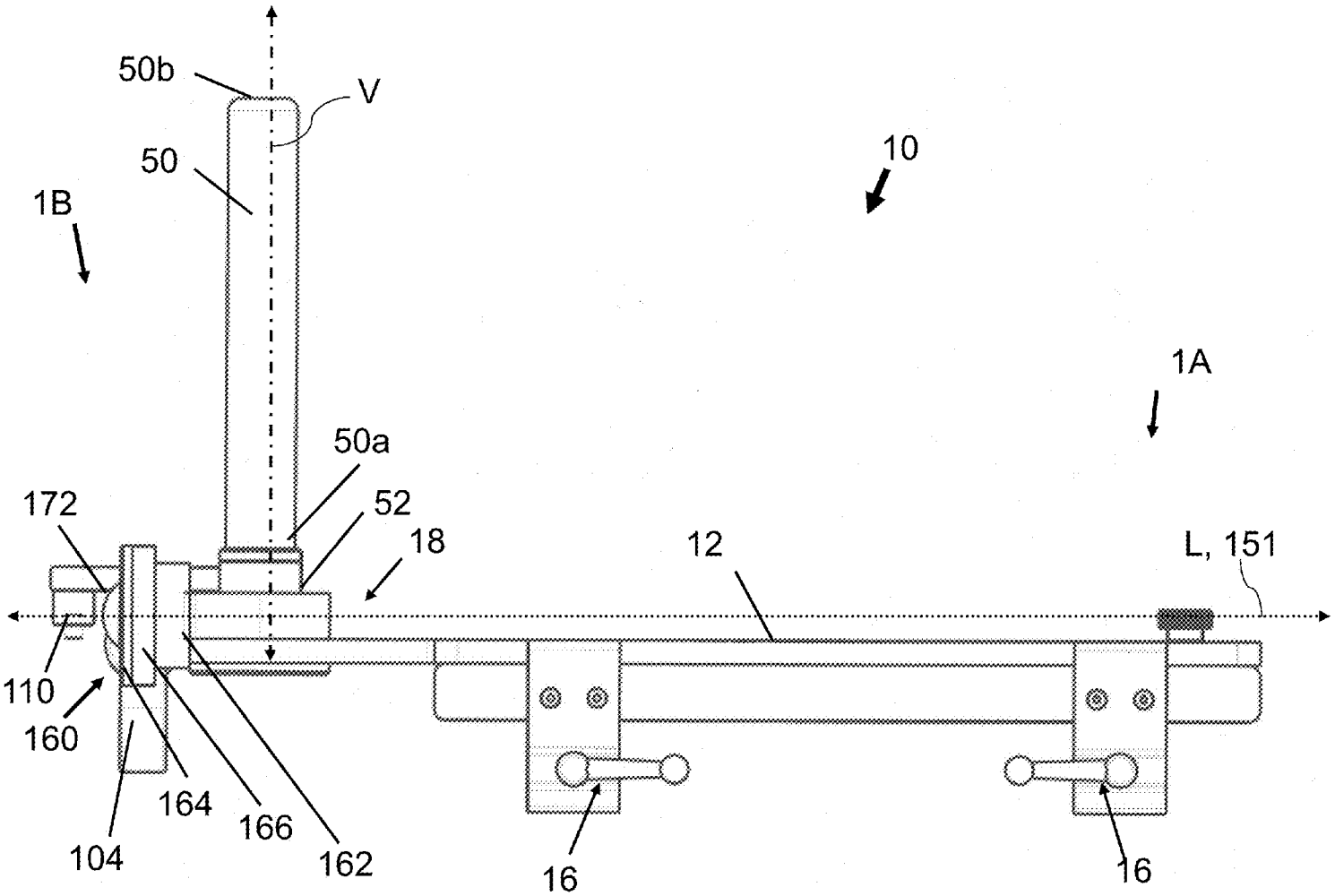
FIG. 5 is an opposite side view of the system of FIG. 1.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components.

As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Additionally, as used herein, the terms "bed" and "table" refer to a patient bed, operating table, an examination bed, or other medical bed or table used for medical procedures, operations, diagnostics, care, or combinations thereof.

Referring now to FIGS. 1-8, an embodiment of a system 10 for adjustably restraining, positioning, and supporting a patient's pelvis and lower limb (i.e., leg) during surgery or diagnostic evaluation is shown. In this embodiment, system 10 includes a base or pelvic support 12, a perineal post 50 extending perpendicularly upward from support 12, and an adjustable femoral support 100 pivotally coupled to support 12. In general, support 12 is secured to the bed or table and supports the patient's pelvis, post 50 is positioned between the patient's legs and helps maintain the position of the patient's pelvis on the support 12, and support 100 releasably supports one of the patient's legs extending from support 12.

Post 50 is fixably secured to pelvic support 12, and femoral support 100 is moveably coupled to pelvic support 12. In addition, pelvic support 12 moveably couples system 10 to a patent's bed or operating room (OR) table via lockable couplings 16 secured to the lateral sides of pelvic support 12. In particular, couplings 16 positively engage mating side rails on the sides of the bed or table, thereby allowing support 12 and system 10 to be moved axially along a longitudinal axis L of the bed or table between a first end 1A and a second end 1B. Each coupling 16 is a clamping device that releasably locks the pelvic support 12 to a corresponding bed rail. Specifically, each coupling 16 has a locked position in fixed engagement with one bed rail and an unlocked position slidably engaging one bed rail. Thus, when any one or more of the couplings 16 are locked, the pelvic support 12 is fixed at a particular axial position along the bed or table; and when each and every one of the couplings 16 is unlocked, pelvic support 12 is free to be moved axially relative to the bed or table via sliding engagement of couplings 16 and the bed rails.

In this embodiment, pelvic support 12 is generally planar polygonal-shaped board or plate. More specifically, pelvic support 12 includes a rectangular base 13 and a trapezoidal extension 18 extending axially from base 13. Support 12 is positioned and oriented such that rectangular base 13 is axially adjacent the bed or table, and extension 18 extends axially therefrom. Base 13 is configured to support the patient's pelvis, and extension 18 is configured to be positioned generally between the patient's legs. Post 50 and femoral support 100 are coupled to extension 18.

Base 13 of pelvic support 12 includes a through slot or aperture 14 that defines a handle for grasping and positioning system 10. Extension 18 tapers laterally inward (i.e., the lateral width of extension 18 decreases) moving axially away from base 13, thereby forming reliefs or recesses in pelvic support 12 on either side of extension 18. Reliefs 20 are generally configured to permit manipulation and positioning of a patient's leg below the pelvic support 12. The outer edge 22 of pelvic support 12 extending along each extension 18 and relief 20 is preferably padded, cushioned, or lined with a deformable material to soften impingement of the patient's leg.

Pelvic support 12 also includes a receiver 24 positioned below base 13 between couplings 16. In general, receiver 24 is configured to receive and retain an imaging cassette, detector or sensor (e.g., X-ray imaging cassette) below support 12 and above the bed or table. In this embodiment, receiver 24 is a slotted bracket having an L-shaped cross section defining a recess sized to slidingly receive an imaging cassette. In other embodiments, the receiver (e.g., receiver 24) comprises a drawer that is positioned below support 12 and can be moved axially relative to support 12. The receiver 24 can include latches, locks, stops, or interference fitment in order to releasably retain an imagining cassette in a given position.

In general, pelvic support 12 can be made of any rigid material suitable for use with patients in an imaging or operating room. Pelvic support 12 can be made of a material that is transparent to X-rays. In addition, padding, cushioning, or other deformable material may be provided on pelvic support 12 to enhance patient comfort and/or soften impingement of the patient. In instances where padding or cushioning is provided on pelvic support 12, it is preferably removable or replaceable to facilitate sterilization.

Referring now to FIGS. 1-5, post 50 has a vertical axis V oriented perpendicular to axis L and support 12, a lower end 50*a* secured to extension 18 of pelvic support 12 with a mount or bracket 52 and an upper end 50*b* distal support 12. Bracket 52 can be configured to allow removal of post 50 from system 10 to facilitate patient positioning. For example, end 50*a* of post 50 can be removably threaded into a mating receptacle in bracket 52 or releasably received and locked within a mating receptacle in bracket 52. Post 50 has a length measured between ends 50*a*, 50*b* that is preferably between about 30 cm and about 50 cm. End 50*b* of post 50 is rounded and smooth to prevent the snagging of medical equipment, wires, air-hoses, clothing, and sterile drapes.

As previously described, post 50 is configured for positioning between a patient's legs or perineum, and functions to resist fraction forces applied to the patient's leg(s), thereby retain the patient's hips or pelvic on the pelvic support 12 during application of traction. Post 50 can be covered with padding or other means to distribute forces applied to the patient's body during a procedure. Alternatively, post 50 can be configured to deflect incrementally in response to forces applied to the patient's body during a procedure. In still further embodiments, the post 50 may be configured to rotate about the axis V to facilitate patient manipulation during a procedure.

Referring still to FIGS. 1-5, femoral support 100 is pivotally coupled to bracket 52 with a pivot assembly 150 and functions to removably support the patient's right or left leg/thigh extending into the corresponding relief 20. As will be described in more detail below, femoral support 100 includes a handle 102, a frame 104, and a support member 110.

Pivot assembly 150 allows femoral support 100 to pivot relative to support 12 about a first pivot 151 oriented parallel to axis L and a second pivot 152 disposed in a vertical plane oriented perpendicular to axes L, 152. In this embodiment, pivot assembly 150 includes a first pivot joint or coupling 160 configured to rotate or pivot about first axis 151 and a second pivot joint or coupling 170 configured to rotate or pivot about second axis 152. First pivot coupling 160 includes a spindle 162, a retainer 164, and a hub 166 having a radial extension 168 defining second pivot axis 152. In other words, second pivot axis 152 is coincident with the central or longitudinal axis of extension 168. Second pivot coupling 170 is configured to rotate or pivot about axis 152 of radial extension 168.

Spindle 162 of the first pivot coupling 160 is coupled to mount 52 and rotatably supports hub 166. In this embodiment, spindle 162 is integral with mount 52 (i.e., spindle 162 and mount 52 are a single piece). More specifically, spindle 162 is a cylindrical extension of mount 52. Spindle 162 is may be polished to facilitate a sliding-engagement or rotation, or spindle 162 may comprise bearing races, bushings, and other components configured to permit rotation therearound.

Hub 166 comprises an annular body disposed around spindle 162 and including the radial extension 168. Hub 166 is configured to rotate relative to spindle 162 about axis 151 coaxially aligned with spindle 162. Axes L, 151 are horizontal, and thus, the hub 166 and extension 168 rotate in a vertical plane parallel to the post 50. Hub 166 may include bearings, bushings, races, and other assemblies for rotatably contacting spindle 162. Alternatively, hub 166 may comprise a smooth or polished surface to facilitate sliding engagement with the spindle 162.

Retainer 164 is fixably secured to spindle 162 and functions as an end cap to prevent hub 166 from sliding off and disengaging spindle 162. Thus, the retainer 164 retains hub 166 on spindle 162. Retainer 164 may include a washer, castle-nut, or cotter pin to secure retainer 162 to spindle 162. Retainer 164 preferably has a smooth outer surface to prevent snagging medical blankets, surgical drapes, or sterile drapes during a procedure.

In this embodiment, hub 166 includes a stop 163 configured to releasably lock hub to spindle 162, thereby preventing hub 166 from rotating relative to spindle 162. In general, the stop 163 may be any suitable mechanism for releasably locking hub 166 to spindle 162 including, without limitation, a pin, a set screw, a compression release or the like.

Radial extension 168 extends radially from hub 166 and has a central axis coincident with axis 152 as previously described. In this embodiment, the radial extension 168 is configured similarly to spindle 62. Namely, radial extension 168 is cylindrical, and may be polished to facilitate a sliding-engagement or rotation, or may comprise bearing races, bushings, and other components configured to permit rotation therearound.

Radial extension 168 defines the location of rotation for the second pivot coupling 170. In particular, second pivot coupling 170 is configured to rotate around axis 152 and be supported on the radial extension 168. Second pivot coupling 170 comprises a sleeve 172 is concentrically disposed about radial extension 168 and slidingly engages extension 168, thereby allowing sleeve 172 to rotate around axis 152 relative to extension 168. Sleeve 172 and radial extension 168 preferably comprise bushings or bearings configured to permit rotation of sleeve 172 relative to extension 168 about axis 152.

In this embodiment, sleeve 172 includes a stop 174 configured to releasably lock sleeve 172 to extension 168, thereby preventing sleeve 172 from rotating relative to radial extension 168. In general, the stop 174 may be any suitable mechanism for releasably locking sleeve 172 to extension 168 including, without limitation, a pin, a set screw, a compression release or the like.

Referring now to FIGS. 1-8, the femoral support 100 is coupled to sleeve 172 of the second pivot coupling 170. As previously described, femoral support 100 includes handle 102, frame 104, and support member 110. Frame 104 extends axially (relative to axis 152) from sleeve 172 and is the structural element of femoral support 100. Frame 104 is coupled to sleeve 172 such that rotation of sleeve 172 about axis 152 also results in rotation of frame 104 about axis 152. In this embodiment, frame 104 is integral with sleeve 172 (i.e., sleeve 172 and frame are a single piece). Alternatively, the frame (e.g., frame 104) may be removably coupled to the sleeve (e.g., sleeve 172) and/or the radial extension (e.g., radial extension 168), for example to facilitate cleaning and sterilization. Frame 104 is preferably made from a rigid material suitable for use with patients in an imaging or operating room.

Handle 102 is coupled to frame 104 generally opposite sleeve 172. In general, handle 102 provides an interface for manual manipulation of femoral support 100 about the first pivot 150 and second pivot coupling 170. For example, a surgeon, doctor, nurse, or other healthcare professional can grasp and manipulate handle 102 to position frame 104 and support 110 as desired. Handle 102 may comprise an ergonomic shape, padding, or covering.

Handle 102 may comprise an actuator 108 in communication with stop 163 of the first pivot 150 and stop 174 of the second pivot coupling 170. The actuator 108 may be any electric or mechanical interface, switch, or connection configured to engage and release stops 163, 174. Alternatively, actuator 108 may be any system configured to activate or operate another medical device in an OR.

Support 110 is configured to support the upper leg and thigh of a patient. In embodiments, support 110 is generally concave so as to at least partially support the circumference or cradle the patient's leg. In instances, support 110 may comprise flexible, elastic, deformable, or otherwise resilient material. In this embodiment, support 110 is a plurality of resilient flexible straps extending across a "U"-shaped frame 104. In other embodiments, support 110 may comprise a generally concave mounted to the frame 104.

As described above and illustrated in FIGS. 1-9, system 10 is employed for medical and surgical procedures related to the assessment and treatment of a patient's leg, pelvis, or both. Prior to a procedure, the pelvic support 12 is positioned on an operating room (OR) bed such that each coupling 16 engages a rail on the bed. Once the desired position of support 12 relative to the bed is achieved, couplings 16 are locked to maintain the desired position of support 12. Generally, extension 18 overhangs the end of the bed.

During a procedure, the patient is secured to bed such that the lower torso and pelvis are positioned atop pelvic support 12. The patient's legs are positioned on opposite side of mount 52 such that post 50 may extend therebetween in contact with the perineum. The patient's leg or legs may be supported by additional devices such as those disclosed in U.S. patent application Ser. Nos. 61/585,969 and 61/451, 985, each of which is hereby incorporated herein by reference in its entirety for all purposes.

Referring now to FIGS. 1-5, the first pivot 150 may initially be rotated downward to position femoral support 100 generally below the pelvic support 12 or decoupled from support 12 prior to positioning the patient on support 12. Once the patient is positioned on pelvic support 12, the post 50, and femoral support 100 may be coupled to the mount 52 and/or rotated downward generally below support 12. In general, the femoral support 100 is positioned out of the way of the surgeon and medical personnel in the OR until it is need to facilitate part of the procedure. During the procedure, when the femoral support 100 is needed, the first pivot coupling 160 is unlocked in order to move support 110 into one of the reliefs 20, and the second pivot coupling 170 is simultaneously unlocked such that support 110 is free to rotate about axis 152 in response to manual manipulation of handle 102.

In general, femoral support 100 may be used to simply support patient's leg during arthroscopic or internal orthopedic procedures, or actively employed to apply dorsal or ventral fraction to the patient's leg, particularly during orthopedic procedures to the hip joint. In certain instances, a surgeon may utilize handle 102, to lift the patient's thigh upward above the pelvic support 12. Continuing the lifting or upward motion results in the rotation of femoral support 100 about the longitudinal axis L running through the first pivot 150. As such, the femoral support 100 may be used to apply medial fraction to the upper thigh, such that the post 50 acts as a fulcrum to apply lateral fraction to the hip joint. In embodiments, once a desired position is achieved the surgeon or other OR personnel may engage the stop 163 for the first pivot and the stop 174 for the second pivot. Retaining the support system 100 in the desired position may permit the completion of various procedures and operations on the joint.

Figure 6:
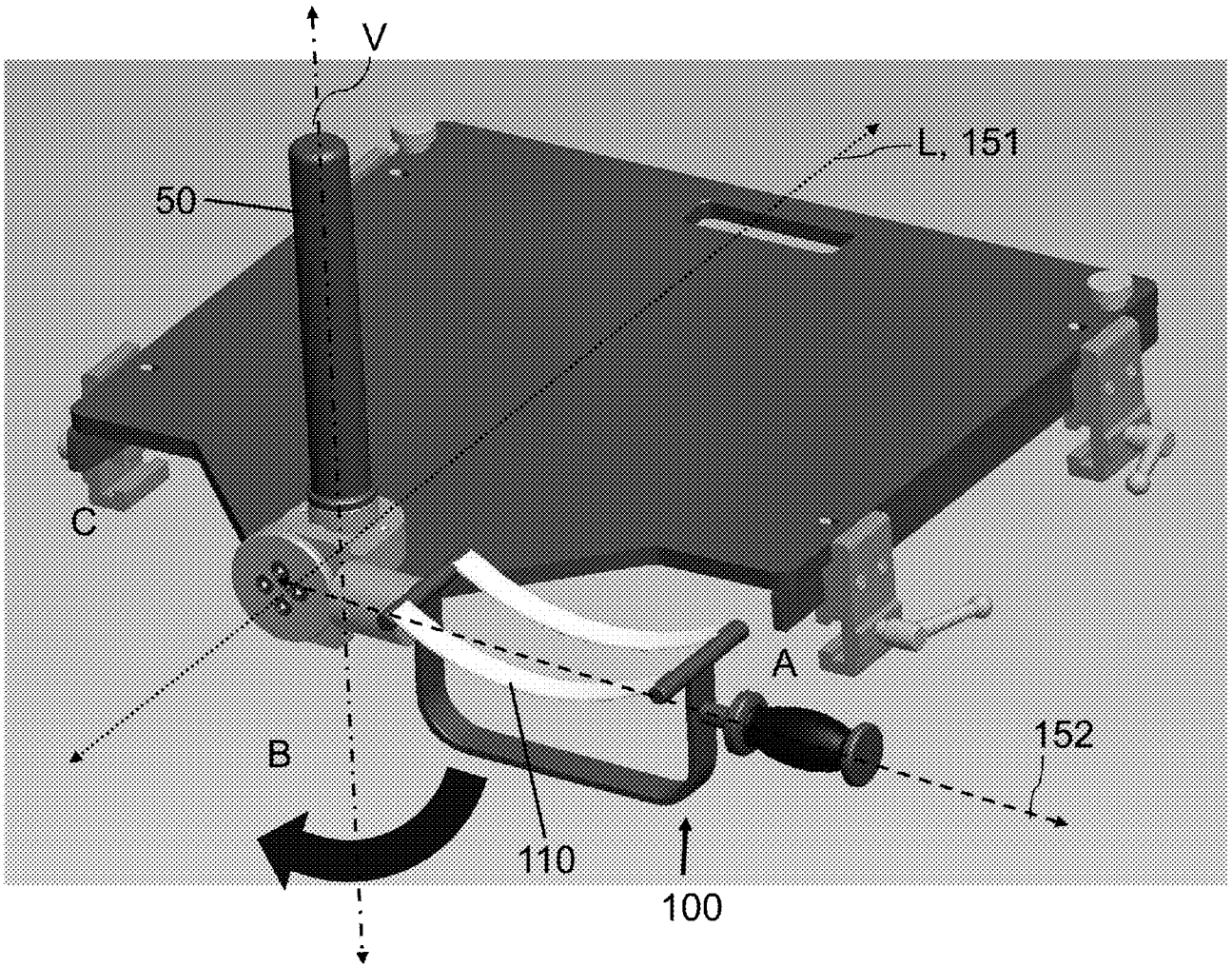
FIG. 6 is a perspective view of the system of FIG. 1 positioned to support the patient's left leg.
Figure 7:
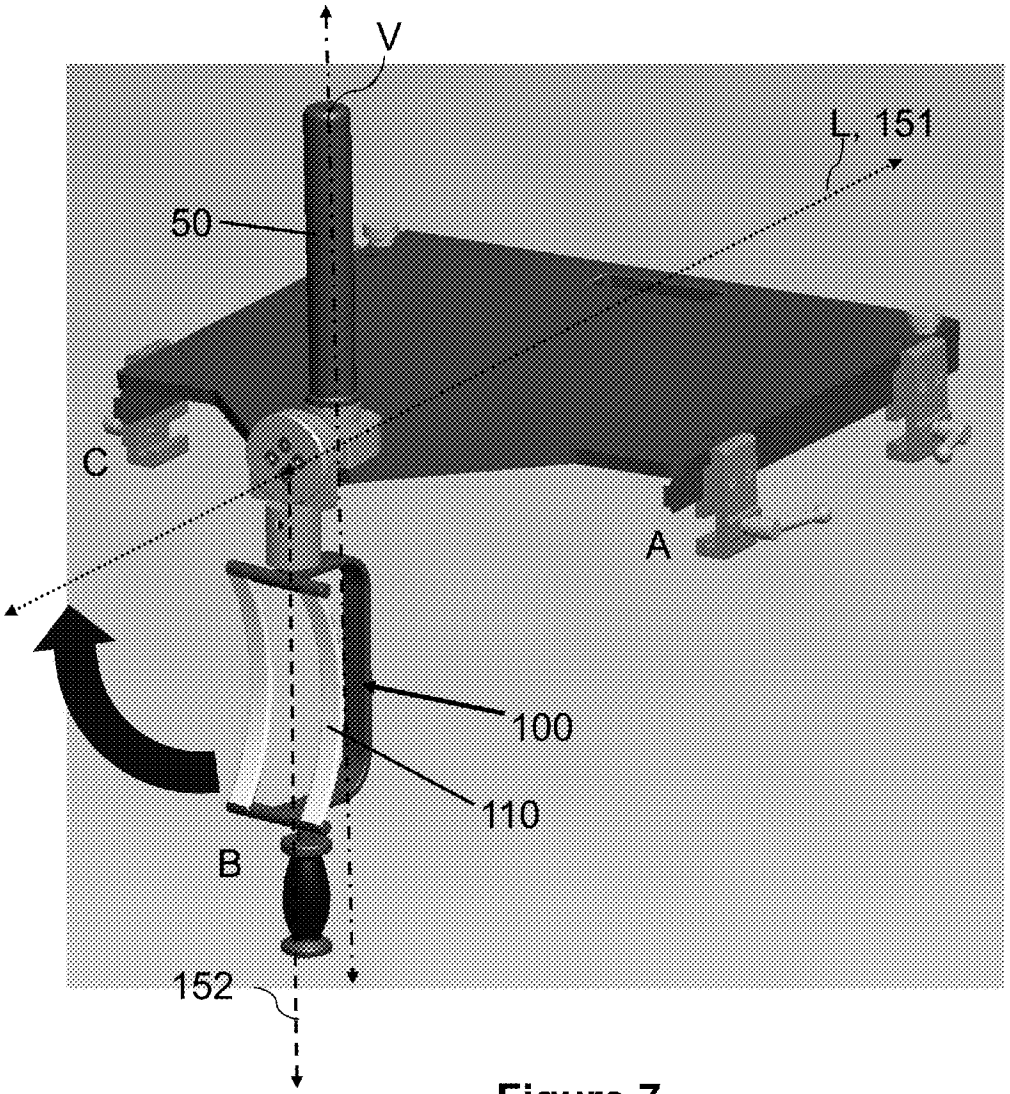
FIG. 7 is a perspective view of the system of FIG. 1 positioned in a neutral position.
Figure 8:
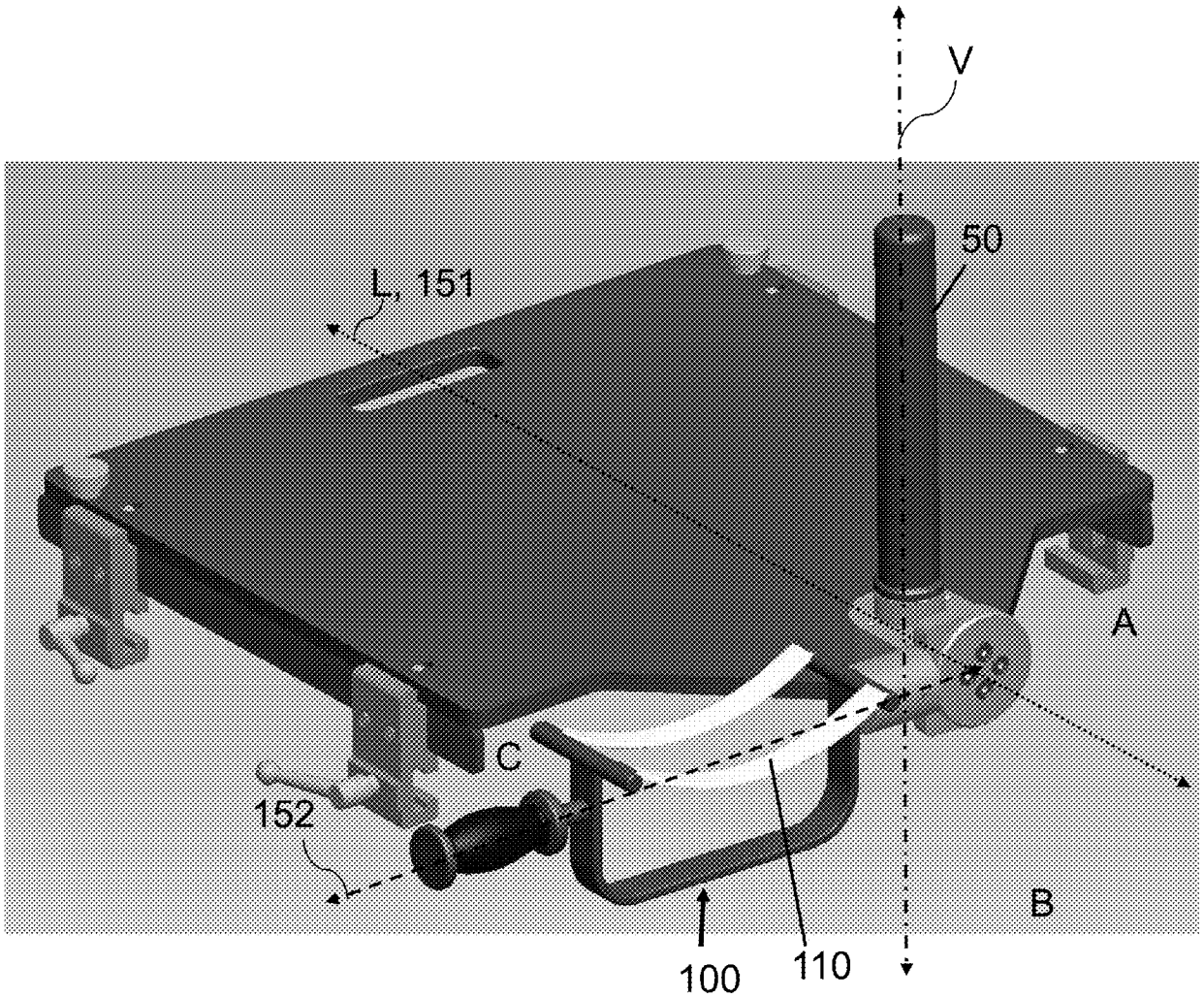
FIG. 8 is a perspective view of the system of FIG. 1 positioned to support the patient's right leg.

Referring now to FIGS. 6 through 8, there is illustrated one embodiment of the sequence of steps for translating the femoral support 100 from a first position A, for example in position to support the patient's left leg to an intermediate position B, and then to a second position C to support a patient's right leg. It may be understood that the sequence of steps is reversible in the opposite direction, for example from second position C to first position A, via intermediate position B. Additionally, intermediate position B may be used to store or keep the femoral support 100 out of the way, such that femoral that hangs downward or vertically opposite from the post 50, for example to permit OR personnel to position and secure the patient.

Generally, the radial axis 152 of the femoral support 100 is parallel with the vertical axis V of the post 50 in the intermediate position B. During manipulation, the femoral support 10 rotated approximately ninety degrees around axis L between from the intermediate position B to either the first position A or the second position C. In this configuration, the radial axis 152 is generally perpendicular to the vertical axis V and the longitudinal axis L. Additionally, the femoral support 100 is rotated approximately ninety degrees around the radial axis 152 during movement from intermediate position B to either the first position A or the second position C. As such, the support 110 configured to contact and support the patient's leg is rotated to the generally upward facing configuration shown for the first position A and second position C.

In certain embodiments described hereinabove, the support is generally cylindrical and does not need to be rotated about axis 152 to contact and support the patient's leg properly. Alternatively, the femoral support 100 may be utilized to apply vertical fraction in a downward direction to the patient's leg. In this alternate use, second position B may be positioned vertically adjacent to the post 50.

Figure 9:
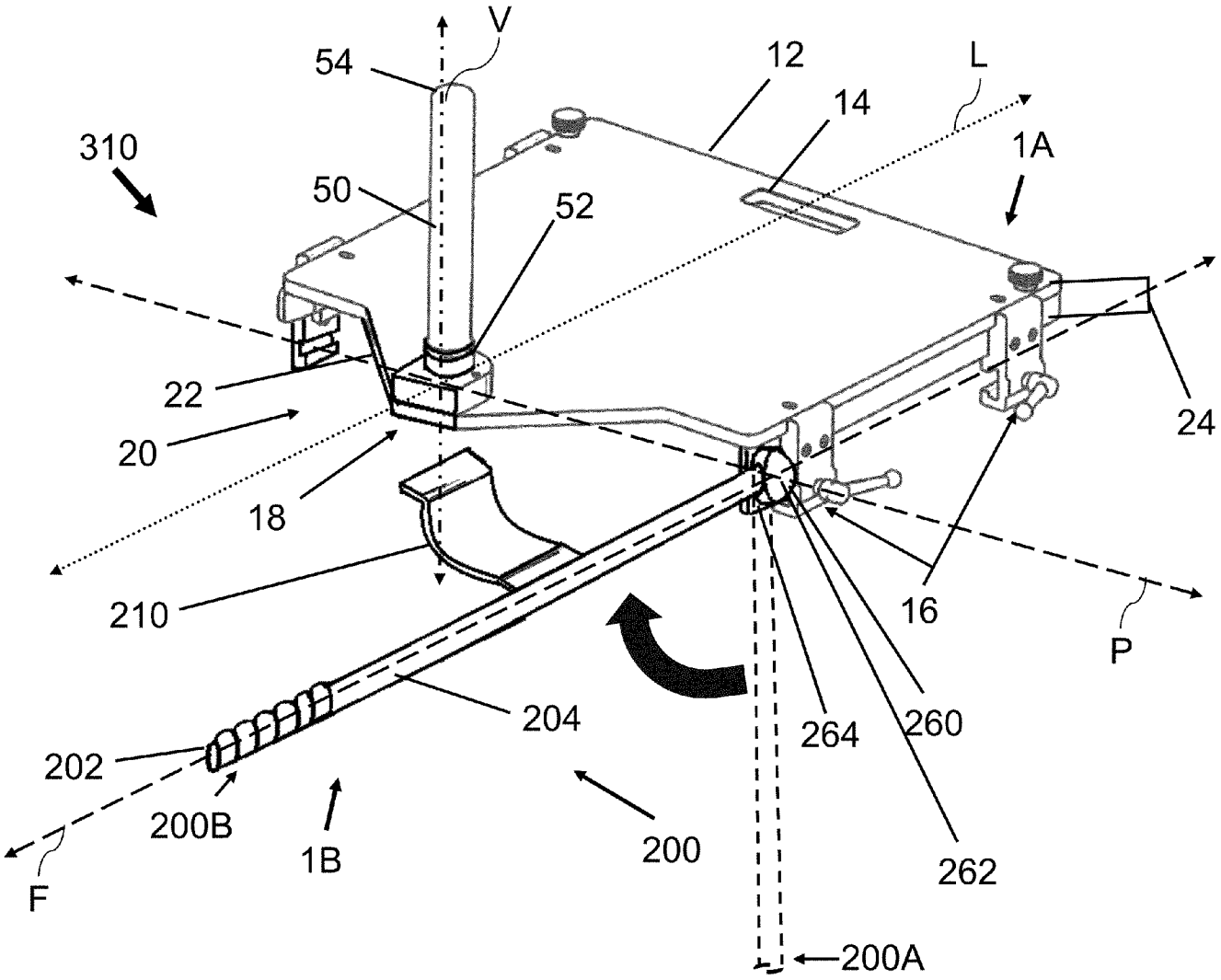
FIG. 9 is a perspective view of an embodiment of an adjustable femoral support system in accordance with the principles described herein.

Referring now to FIG. 9, an embodiment of a femoral support system 310 for adjustably restraining, positioning, and supporting a patient's pelvis and lower limb (i.e., leg) during surgery or diagnostic evaluation is shown. System 310 is substantially the same as system 10 previously described. In particular, system 310 includes pelvic support 12, lockable couplings 16, and post 50, each as previously described. However, in this embodiment, femoral support 100 is replaced with a femoral support 200, which is pivotally coupled to pelvic support 12 laterally offset from extension 18.

In this embodiment, femoral support 200 includes a handle 202, a frame 204, and a support member 210. A pivot joint or coupling 260 rotatably or pivotally couples frame 204 to pelvic support 12. Support member 210 is generally configured for positioning laterally adjacent extension 18 for example in reliefs 20 of pelvic support 12. Handle 204 is configured for manual manipulation of the support member 210.

Pivot coupling 260 is coupled to the pelvic support 12 by a tab 264. Tab 264 is configured as a generally planar extension coupled to the underside of and extending vertically downward from the pelvic support 12. Alternatively, the tab 264 may be configured as an extension from the couplings 16 or receivers 24. Still further, the tab 264 may be reversibly coupled to the OR be itself.

In general, pivot coupling 260 is a hub-on-spindle assembly as described hereinabove (e.g. for pivot coupling 160). Pivot coupling 260 includes a lockable retainer 262 for reversibly fixing the pivot 260 in an operator determined position. The pivot 260 permits repositioning the femoral support 200 from a hanging position 200A to a support position 200B. The hanging position 200A may be an approximately vertical position, such that the support 200 hangs off the retainer 264. The support position 200B is configured to retain the support 200 in an approximately horizontal position.

Pivot 260 supports the frame 204 extending from tab 264 and pelvic support 12. Generally, frame 204 is a linear member, having a central or longitudinal axis F. Handle 202 is positioned on the frame 204 distally from the pivot 260. Support member 210 extends perpendicular from frame 204 into the relief 20 of the pelvic support 12. Support member 210 may be concave in order to partially support a patient's thigh circumference. Generally, the support member 210 is fixed to the frame 204, but in certain configurations, the support member 210 may be configured to traverse the frame 204 along axis F, for example to adjust to a patient's thigh length. In moveable configurations, the support member 210 is reversible fixed to the frame by releases, such as those previously described.

In further configuration of the present embodiment, the pivot 260 may be further configured to include indexing features, such that the lockable retainer 262 engages the indexing features to reversibly fix the pivot 260 in incremental positions between the hanging position 200A and the support position 200B. Further, the pivot 260 is configurable as a ball-joint or spherical joint. In instances, a ball-joint configuration of the pivot 260 permits the adduction/abduction of the patient's leg relative to the post 50 and the longitudinal axis L. Without limitation, the adduction/abduction movement of the pivot 260 may be differentially controlled by operation of the lockable retainer 262. Pivot 260 may be configured to permit the frame 204 to rotate around frame axis F.

Referring still to FIG. 9, the support 200 may initially in the vertical position 200A. The lockable retainer 262 may be unlocked, such that the support 200 may be moved into the support position 200B. Once the patient is positioned on pelvic support 12, in contact with the post 50, the femoral support 200 is positioned out of the way of the surgeon and medical personnel in the OR until it is need to facilitate part of the procedure. During the procedure, when the femoral support 200 is needed, lockable retainer is unlocked in order to move support 210 into one of the reliefs 20 in response to manual manipulation of handle 102.

In general, support 200 may be used to simply support patient's leg during arthroscopic or internal orthopedic procedures, or actively employed to apply dorsal or ventral fraction to the patient's leg, particularly during orthopedic procedures to the hip joint. In certain instances, a surgeon may utilize handle 202, to lift the patient's thigh upward above the pelvic support 12 and for example above the horizontal position 200B. Continuing the lifting or upward motion results in the rotation of femoral support 200 about the pivot axis P running through the pivot 260. Further, the pivoting or rotation of the support 200 in adduction or abduction may be used to apply medial traction to the upper thigh, such that the post 50 acts as a fulcrum to apply lateral traction to the hip joint. In embodiments, once a desired position is achieved the surgeon or other OR personnel may engage the locakable retainer 262. Retaining the support system 200 in the desired position may permit the completion of various procedures and operations on the joint.

The components of systems 10, 310 are preferably made from material(s) that can be sterilized, for example by an autoclave. Suitable materials include, without limitation, composites, plastics, metals and metal alloys, or combinations thereof. Additionally, systems 10, 310 are modular, such that any of the components of systems 10, 310 may be replaceable, thereby allowing replacement of a worn or damaged part without having to replace the entirety of the system 10, 310.

Since systems 10, 310 are modular, it may be differentially sterilized dependent on a surgeons preferences and/or the procedure being performed. As is known in the art, sterile drapes are used to cover and isolate unsterilized equipment in an operating room. Components that are below the drape are not necessarily sterilized but, those that are positioned above the drape must be sterile to reduce the potential for infections. As such, a sterile drape may be positioned such that the pelvic support 12 may be positioned below the sterile drape and perineal post 50 and femoral support 100, 200 are positioned above the drape. Alternatively, it may be envisioned that post 50 and pelvic support 12 are below the sterile drape and femoral support 100, 200 are positioned above the drape. In further alternate configurations, only handle 102, 202 may be positioned above the sterile drape.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A femoral support system, comprising:

a pelvic support plate configured to be moveably coupled to a table, wherein the pelvic support plate has a central axis, a first end, a second end opposite the first end, a first lateral side extending from the first end to the second end, and a second lateral side extending from the first end to the second end, wherein the central axis is disposed between the first lateral side and the second lateral side;

a pivot joint coupled to the first lateral side of the pelvic support plate at the second end, wherein the pivot joint has a horizontal pivot axis oriented perpendicular to the longitudinal axis;

an elongate frame having a pivot end coupled to the pivot joint and a free end distal the pivot joint;

a handle disposed at the free end of the elongate frame;

a femoral support coupled to the elongate frame between the pivot end and the free end, wherein the femoral support extends laterally from the elongate frame toward a projection the central axis of the pelvic support plate, and wherein the femoral support is configured to directly support the thigh of the patient;

wherein the elongate frame is configured to rotate upward in a vertical plane about the pivot axis from a first position extending downward from the pivot joint with the femoral support spaced below the patient to a second position with the femoral support directly supporting and applying traction to the thigh of the patient, and wherein the elongate frame is configured to rotate downward in the vertical plane about the pivot axis from the second position to the first position, wherein the vertical plane is oriented perpendicular to the pivot axis and parallel to the longitudinal axis;

wherein the handle is configured to be manually manipulated to transition the elongate frame from the first position to the second position.

2. The system of claim 1, further comprising a perineal post coupled to the pelvic support plate between the first lateral side and the second lateral side, wherein the perineal post extends perpendicularly from the pelvic support plate, and wherein the perineal post is configured to be positioned between the legs of the patient.

3. The system of claim 2, wherein the second end of the pelvic support plate comprises an extension, a first relief extending laterally from the extension to the first lateral side, and a second relief extending laterally from the extension to the second lateral side;

wherein the femoral support is laterally positioned between the extension and the support frame.

4. The system of claim 2, wherein the pivot joint comprises a spindle fixably coupled to the pelvic support plate and a hub rotatably disposed about the spindle, and wherein the first end of the elongate frame is attached to the hub.

5. The system of claim 1, wherein the support frame is oriented substantially vertical in the first position and oriented horizontal in the second position.

6. The system of claim 1, wherein an underside of the plate includes a pair of laterally spaced receivers configured to receive an imaging cassette.

7. The system of claim 1, wherein the pivot joint is mounted to a tab extending downward from the pelvic support plate.

8. The system of claim 1, further comprising a plurality of lockable couplings attached to each lateral side of the support plate, wherein the lockable couplings are configured to releasably lock the pelvic support plate relative to the table.

9. A femoral support system, comprising:

a pelvic support plate configured to be moveably coupled to a table, wherein the pelvic support plate has a central axis, a first end, a second end opposite the first end, a first lateral side extending from the first end to the second end, and a second lateral side extending from the first end to the second end, wherein the central axis is disposed between the first lateral side and the second lateral side;

a perineal post attached to the second end of the support plate and configured to be positioned between the legs of a patient; and a femoral support pivotally coupled to the first lateral side of the pelvic support plate proximal the second end with a pivot joint;

wherein the femoral support is configured to rotate upward relative to the pelvic support plate between a first position extending downward from the pivot joint and a second position directly supporting the thigh of the patient;

wherein the femoral support comprises a frame, a handle, and a femoral support, wherein the frame has a pivot end coupled to the pivot joint and a free end distal the pivot joint;

wherein the handle is disposed at the free end of the frame and is configured to be manually manipulated to transition the femoral support member from the first position to the second position;

wherein the femoral support member is coupled to the frame between the pivot end and the free end, and wherein the femoral support member extends laterally from the frame toward a projection of the central axis.

10. The system of claim 9, wherein the femoral support is configured to rotate in a vertical plane relative to the pelvic support plate about a pivot axis, and wherein the vertical plane is oriented perpendicular to the pivot axis and parallel to the central axis.

11. The system of claim 10, wherein the pivot joint comprises a spindle coupled to the pelvic support plate and a hub rotatably mounted to the spindle, wherein the femoral support extends from the hub.

12. The system of claim 9, further comprising a plurality of lockable couplings attached to each lateral side of the support plate, wherein the lockable couplings are configured to releasably lock the support plate relative to the table.

13. The system of claim 9, wherein the femoral support member has a concave upper surface configured to receive and support the patient's thigh.

14. The system of claim 9, wherein the second end of the pelvic support plate comprises an extension, a first relief between the extension and the first lateral side, and a second relief between the extension and the second lateral side;

wherein the perineal post is coupled to the extension.

15. The system of claim 9, wherein the pivot joint is coupled to a tab extending downward from the pelvic support plate.

16. The system of claim 9, wherein the femoral support member is moveably coupled to the support frame.

17. The system of claim 9, wherein the femoral support member is fixably attached to the support frame.

18. The system of claim 9, wherein the pivot joint is configured to be releasably locked.

19. The system of claim 9, wherein the pivot joint is a ball joint.

20. The system of claim 9, wherein the femoral support has a linear central axis, and wherein the femoral support is configured to rotate relative to the pelvic support plate about the linear central axis.

* * * * *